United States Patent [19]

Gartner et al.

[11] 4,186,695

[45] Feb. 5, 1980

[54] INTAKE-TUBE ARRANGEMENT FOR INTERNAL COMBUSTION ENGINES

[75] Inventors: Jurij Gartner, Germering; Jiri Seidl, Munich, both of Fed. Rep. of Germany

[73] Assignee: Bayerische Motoren Werke, Fed. Rep. of Germany

[21] Appl. No.: 885,988

[22] Filed: Mar. 13, 1978

[30] Foreign Application Priority Data

Aug. 12, 1977 [DE] Fed. Rep. of Germany ..... 2736466

[51] Int. Cl.[2] ..... F02B 75/20

[52] U.S. Cl. ..... 123/52 M; 123/59 R

[58] Field of Search ..... 123/52 R, 52 M, 52 MC, 123/52 MV, 59 R, 59 A

[56] References Cited

U.S. PATENT DOCUMENTS

| | | | |
|---|---|---|---|
| 1,359,166 | 11/1920 | Good | 123/52 M |
| 2,175,438 | 10/1939 | Manning | 123/52 M |
| 2,241,461 | 5/1941 | Jacoby | 123/52 M |
| 2,640,471 | 6/1953 | Haltenberger | 123/52 MV |
| 2,882,875 | 4/1959 | Kolbe | 123/52 MV |
| 3,141,449 | 7/1964 | Dika | 123/59 R |
| 3,878,826 | 4/1975 | Date et al. | 123/52 MV |

FOREIGN PATENT DOCUMENTS 2645601 4/1977 Fed. Rep. of Germany ..... 123/52 M

*Primary Examiner*—Charles J. Myhre
*Assistant Examiner*—Craig R. Feinberg
*Attorney, Agent, or Firm*—Craig and Antonelli

[57] ABSTRACT

An intake pipe arrangement for internal combustions is provided which includes an intake manifold and intake pipes arranged symmetrically pairwise at opposite sides thereof. In order to reduce the mutual vibrational influence of the intake pipes, the intake pipes are connected at the intake manifold with the end segments of the intake pipes approaching the intake manifold extending diagonally with respect to one another so that their imaginary extensions intersect in the intake manifold.

3 Claims, 2 Drawing Figures

INTAKE-TUBE ARRANGEMENT FOR INTERNAL COMBUSTION ENGINES

BACKGROUND AND SUMMARY OF THE INVENTION

The invention relates to an intake-tube arrangement for internal combustion engines, whereby individual intake tubes, disposed pairwise opposite one another in approximately the same plane, said tubes being of substantially the same length, extend out from the lateral walls of an intake manifold.

In a known intake tube arrangement of this design (U.S. Pat. No. 2,862,490) for a six-cylinder in-line internal combustion engine with three carburetors, the connections of each pair of individual intake tubes to the intake manifold are located coaxially opposite one another, so that a disadvantageous mutual vibrational influence takes place between the individual intake tubes located opposite one another, said influence resulting in deterioration of supply to the engine. Moreover, the individual intake tubes consist essentially of straight and diagonal sections, connected together by bends with small radii of curvature. In this design, the streams of gas or air-gas mixture are disturbed by turbulence in the individual intake tubes, so that especially advantageous torque values and hence efficiencies cannot be achieved over the entire engine speed range. Furthermore, the individual intake tubes are relatively short, resulting in additional disadvantages in torque and efficiency.

A goal of the invention is to provide an intake-tube arrangement of the type described hereinabove, wherein disadvantageous mutual influence of vibrations in individual intake tubes located opposite one another is reduced.

This goal is achieved according to the invention by virtue of the fact that the ends of each two individual intake tubes located opposite one another and extending out from the intake manifold are connected diagonally with respect to one another to the intake manifold, whereby their imaginary extensions, continuing on into the intake manifold, intersect.

The design of the intake pipe arrangement according to the invention ensures a good vibrational behavior in the individual intake tubes and hence a good torque and efficiency for the engine, because direct pressure wave transition between individual intake tubes located opposite one another is disturbed by the fact that they are disposed at angles to one another. The intake pipe arrangement according to the invention is especially suited for fuel-injected internal combustion engines of the Otto and Diesel type, but also for Otto engines fitted with carburetors.

According to particularly preferred embodiments, as also set forth in the claims, the individual intake tubes have relatively large lengths and radii of curvature, without considerably increasing the space requirements for the intake tube arrangement, whereby flow and oscillation behavior are further improved in the individual intake tubes. Certain other features set forth in the claims allow a transition from the individual intake tubes to their connections with favorable flow conditions.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 2:
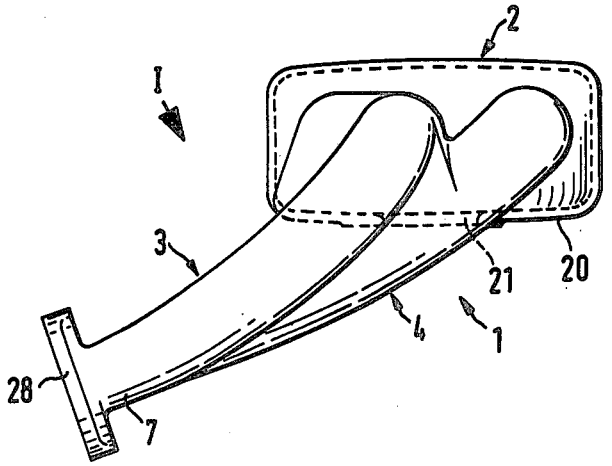
FIG. 2 is a side view of the intake-pipe arrangement according to FIG. 1.
Figure 1:
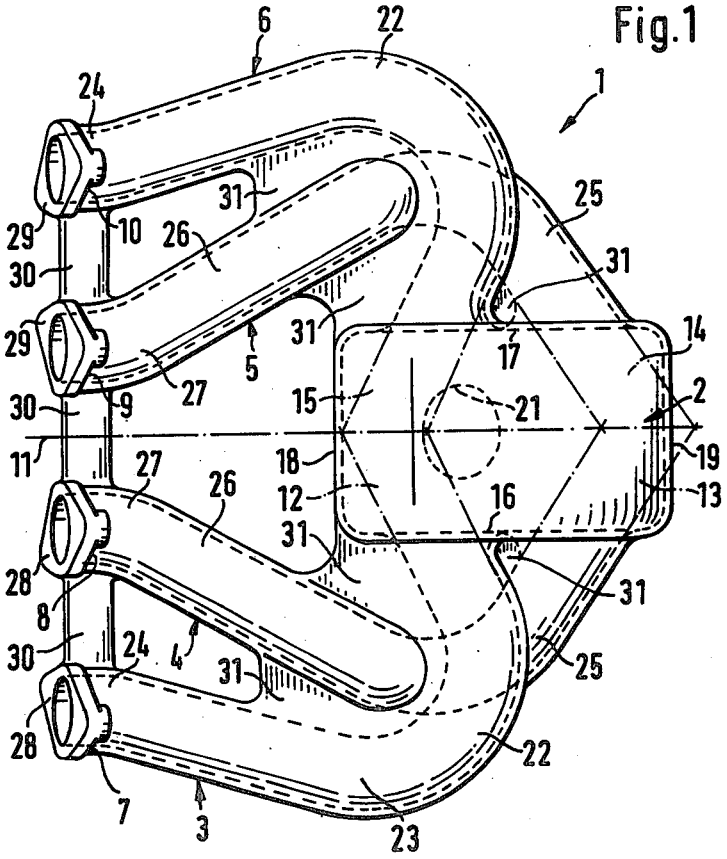
FIG. 1 is a top view of an arrangement of intake tubes for a four-cylinder in-line internal combustion engine along arrow I in FIG. 2, constructed in accordance with a preferred embodiment of the invention.

An intake-pipe arrangement 1 for a four-cylinder fuel-injection in-line internal combustion engine, not shown, designed to operate as an Otto engine, includes an intake manifold 2 and individual intake pipes 3, 4, 5, and 6. Individual intake pipes 3 to 6 run diagonally with respect to each other in an approximately horizontal plane, said pipes being of approximately equal length and extending pairwise opposite one another from intake manifold 2. They overlap one another and are provided with connecting ends 7, 8, 9 and 10, said ends being connectable by flanges with the inlet channels of the internal combustion engine not shown, said connecting ends further extending approximately parallel to one another and to a vertical central lengthwise plane 11 of intake manifold 2. Imaginary extensions 12, 13, 14 and 15 of individual intake pipes 3 to 6, said pipes being connected diagonally to lateral walls 16 and 17 of intake manifold 2, said extensions being shown as dot-dashed lines in the drawing, intersect pairwise with one another in the vicinity of an adjacent end wall 18 or 19 of intake manifold 2. An opening 21 is provided in the lower wall 20 of the intake manifold, to which opening an air intake, not shown, is connectable.

Intake pipes 3 and 6, extending out from intake manifold 2 adjacent to connecting ends 7 to 10, run in a continuous curve 22 from the central lengthwise plane 11 of intake manifold 2 and connecting ends 7 to 10, then back again toward the two of them, then forming a transition with an approximately straight intermediate element and a reverse curve 24, to connecting ends 7 and 10. Individual intake pipes 4 and 5, extending out from the intake manifold at a distance from connecting ends 7 to 10, run in a continuous curve 25 away from the central lengthwise plane 11 of intake manifold 2 and back again toward the latter, as well as simultaneously toward connecting ends, and make a transition with a nearly straight intermediate connecting element 26 with a reverse curve 27 to its connecting ends 8 and 9. All individual intake pipes 3 to 6 are curved downward slightly, whereby the curvature of individual intake pipes 3 and 6, running from connecting ends 7 to 10 adjacent to intake manifold 2, is greater than that of the other two intake pipes 4 and 5.

Connecting ends 7 to 10 are each provided with a flange 28 or 29 and are connected together for reinforcement by webs 30. Individual intake pipes 3 and 4 or 5 and 6 are connected together by walls 31 located in mold joints to provide a design which is easy to cast and for reinforcement.

The fact that the individual intake pipes 3 and 6 or 4 and 5, extending opposite one another outward from intake manifold 2, are connected to intake manifold 2 not pairwise and coaxially, but diagonally with respect to one another, avoids a disadvantageous mutual influence of the oscillations by direct pressure wave transition between the individual intake pipes 3 to 6, thus ensuring a better ramming and engine supply effect for an internal combustion engine fitted with intake-pipe arrangement 2. The intake pipes 3 to 6 which are of the same length, with their approximately equal and relatively large flow-favorable radii of curvature, also contribute to a good oscillation behavior, so that good efficiency and torque values can be achieved with intake-pipe arrangement 1.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Intake-pipe arrangement for internal combustion engines, comprising:

an intake manifold, and intake pipes of approximately equal length and located pairwise from opposite sides of said intake manifold wherein said intake pipes are in communication with one another via said intake manifold, wherein the ends of the respective opposite intake pipes are connected diagonally with respect to one another to the intake manifold, wherein imaginary extensions of the ends of said intake pipes extending into the intake manifold intersect, the distance between the intersections of said extensions being greater than the distance between the connections of said ends of said intake pipes to their respective side of said manifold.

2. Intake-pipe arrangement according to claim 1, whose individual intake pipes are provided with connecting ends arranged in a series and connectable with inlet channels of the engine, and whose intake manifold is disposed approximately centrally across the ends of the connections, whereby the two individual intake pipes extending from the intake manifold and closest to the connecting ends overlap the adjacent individual intake pipes and make a transition to the outer connecting ends of the row, wherein the individual intake pipes extending out from the intake manifold and closest to the connecting ends extend by means of a continuous curve and at least one additional segment from a central lengthwise plane of intake manifold and the connecting ends, said plane being parallel to the connecting ends and at right angles to the row they form and extending back again toward both of them, while individual intake pipes extending out from the intake manifold at a distance from the connecting ends, each depart by means of a continuous curve and at least one additional segment from the central lengthwise plane and back again toward the latter, as well as exclusively toward the connecting ends.

3. Intake-pipe arrangement according to claim 2, wherein all of the individual intake pipes are curved over a considerable portion of their length slightly downward, and wherein a reverse curve is disposed in the vicinity of the connecting ends, the radius of curvature of said reverse curve roughly corresponding to that of the continuous curves.

* * * * *